US005910971A

United States Patent [19]

Ponomarev-Stepnoy et al.

[11] Patent Number: 5,910,971

[45] Date of Patent: Jun. 8, 1999

[54] METHOD AND APPARATUS FOR THE PRODUCTION AND EXTRACTION OF MOLYBDENUM-99

[75] Inventors: Nikolai N. Ponomarev-Stepnoy; Vladimir A. Pavshook; Grigoriy F. Bebikh; Vladimir Ye. Khvostionov; Peter S. Trukhlyaev; Ivan K. Shvetsov, all of Moscow, Russian Federation

[73] Assignee: TCI Incorporated, Albuquerque, N.M.

[21] Appl. No.: 09/028,183

[22] Filed: Feb. 23, 1998

[51] Int. Cl.[6] ..... G21G 1/02

[52] U.S. Cl. ..... 376/189; 376/186

[58] Field of Search ..... 376/186, 189, 376/311, 354–358

[56] References Cited

U.S. PATENT DOCUMENTS

| | | | |
|---|---|---|---|
| 4,284,472 | 8/1981 | Pomares et al. | 376/186 |
| 5,596,611 | 1/1997 | Ball | 376/189 |

*Primary Examiner*—Daniel D. Wasil
*Attorney, Agent, or Firm*—Robert W. Becker & Associates

[57] ABSTRACT

The current invention involves a means for the production and extraction of the isotope molybdenum-99 for medical purposes in a waste free, simple, and economical process. Mo-99 is generated in the uranyl sulphate nuclear fuel of a homogeneous solution nuclear reactor and extracted from the fuel by a solid polymer sorbent with a greater than 90% purity. The sorbent is composed of a composite ether of a maleic anhydride copolymer and α-benzoin-oxime.

13 Claims, 3 Drawing Sheets

METHOD AND APPARATUS FOR THE PRODUCTION AND EXTRACTION OF MOLYBDENUM-99

BACKGROUND OF THE INVENTION

1. Field of the Invention

The present invention relates to methods and systems for separating isotopes from nuclear reactors, and in particular to a method of producing molybdenum-99 (Mo-99) used for medical purposes from the uranyl sulfate nuclear fuel of an aqueous homogeneous solution nuclear reactor.

2. Description of the Prior Art

At the present time more than 50% of the world's annual production of radionuclides are used for medical purposes, such as for the early diagnoses of diseases and for therapy. A basic condition of the use of radionuclides in medicine is the requirement that the radiation exposure of a patient be minimal. This necessitates the use of short-lived radionuclides. A nuclide with a short half-life, however, creates difficulties in transportation and storage. The most used radionuclide for medical purposes is Mo-99 with a half-life of 66 hours. Mo-99 decay results in Tc-99m with a half-life of 6 hours and about 140 keV of gamma (γ) energy convenient for detection. Currently, more than 70% of diagnostic examinations are performed using this radionuclide.

One method of Mo-99 production involves using a target of natural molybdenum or molybdenum enriched in Mo-98 irradiated by a neutron flux in a nuclear reactor. Mo-99 results from a neutron radiation capture $^{98}Mo(n,\gamma)^{99}$. The irradiated target with Mo-99 then undergoes radiochemical reprocessing. This method, however, has a low productivity and the Mo-99 produced is characterized by a low specific activity due to the presence of Mo-98 in the final product.

Another method of Mo-99 production is based on uranium fission under neutron irradiation of a U-Al alloy or electroplated target in a nuclear reactor. The target contains 93% enriched uranium (U-235). After irradiation, the target is reprocessed by one of the traditional radiochemical methods to extract Mo-99 from the fission products. The specific activity achieved by this method is several tens of kilocuries per gram of molybdenum. A serious disadvantage of this method is the necessity of recovering large amounts of radioactive wastes that are byproducts of the fission process. These wastes exceed the Mo-99 material produced by two orders of magnitude. A 24-hour delay in processing the irradiated uranium targets results in a decrease of total activity by about an order of magnitude, during which time the Mo-99 activity decreases by only 22%. After two days, the activity of the waste byproducts exceeds that of the Mo-99 by a factor of six or seven. The problem of long-lived fission product management is the major disadvantage in the production of Mo-99 by this method.

U.S. Pat. No. 5,596,611 discloses a small, dedicated uranyl nitrate homogeneous reactor for the production of Mo-99 in which the radioactive waste products are recirculated back into the reactor. A portion of the uranyl nitrate solution from the reactor is directly siphoned off and passed through columns of alumina to fix some of the fission products, including Mo-99, to the alumina. The Mo-99 and some fission products on the alumina column are then removed through elution with a hydroxide and the Mo-99 is either precipitated out of the resultant elutriant with alpha-benzoinoxime or passed through other columns. This uranyl nitrate reactor has the advantage of recycling the fission byproducts, but the conventional extraction method to obtain Mo-99 is relatively inefficient.

It is an object of the present invention to produce Mo-99 directly from the uranyl sulfate solution of an aqueous-homogeneous solution nuclear reactor in a manner that minimizes the radioactive byproducts and most efficiently uses the reactor's uranium fuel. The process is relative simple, economical, and waste free.

SUMMARY OF THE INVENTION

In the present invention, Mo-99 is generated, along with other fission products, in a uranyl sulfate nuclear-fueled homogeneous-solution nuclear reactor. This reactor operates at powers of from 20 kW up to 100 kW for a period from of several hours to a week producing various fission products, including molybdenum-99. After shutdown and following a cool-down period, the resultant solution is pumped through a solid sorbent material that selectively absorbs the Mo-99. The uranyl sulfate and all fission products not adhering to the sorbent are returned to the reactor vessel, thus containing the fission byproducts and conserving the uranium.

BRIEF DESCRIPTION OF THE DRAWINGS

The various features of novelty that characterize the invention are pointed out with particularity in the claims annexed to and forming a part of this disclosure. For a better understanding of the invention, its operating advantages, and specific objects attained by its uses, reference is made to the accompanying drawing and descriptive matter in which a preferred embodiment of the invention is illustrated.

DESCRIPTION OF THE PREFERRED EMBODIMENT

Figure 1:
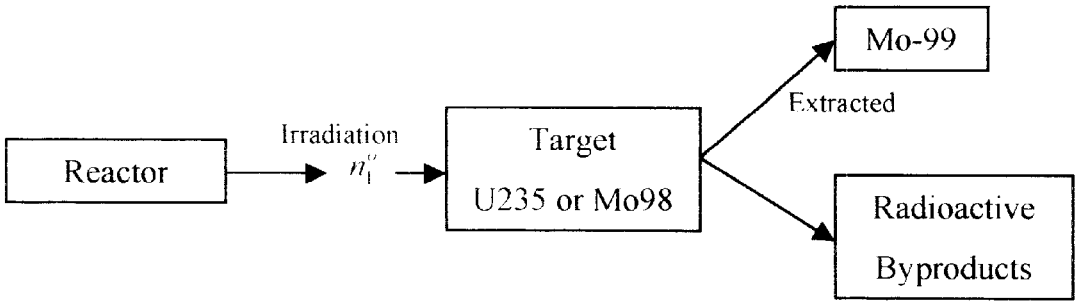
FIG. 1 illustrates the known Mo-99 production method using a U-235 target.

FIG. 1 illustrates the only method that currently exists for the production of Mo-99 that is approved by the U.S. Food and Drug Administration. An enriched uranium target is irradiated by neutrons in a nuclear reactor producing Mo-99 and a large quantity of radioactive wastes. The Mo-99 is chemically extracted from the target. A large quantity of radioactive fission byproducts are also produced by the neutron bombardment of the target that subsequently must be disposed of.

Figure 2:
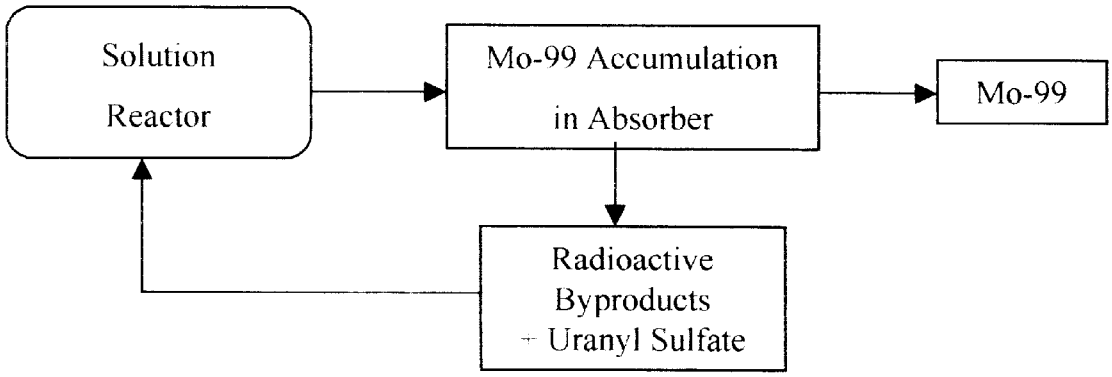
FIG. 2 is a block diagram showing the process of Mo-99 production of the present invention.

The Mo-99 production process flow of the present invention is shown in a diagram in FIG. 2. The molybdenum-99 is extracted from the uranyl sulfate nuclear fuel of a homogeneous solution nuclear reactor. The uranyl sulfate reactor is operated at powers from 20 kW up to 100 kW for a period of from several hours to a week. During this time the fission products, including molybdenum-99, accumulate in the operating reactor solution.

After the operating period, the reactor is shut down and kept at a subcritical condition to reduce the total fission product activity of the nuclear fuel solution and to cool the reactor down. The cooling down period can vary from 15 minutes to several days. The solution is then pumped from the reactor, through a heat exchanger to further reduce the temperature to below 40° C., through a sorption column, and back to the reactor via a closed-loop path. Molybdenum-99 is extracted from this solution by the sorbent with at least 90% efficiency. Less than 2% of the other fission fragments are extracted by the sorbent and less than 0.01% of the uranium are absorbed by the sorbent. The sorbent radioactivity due to the absorbed Mo-99 is about 50 Curies per kW of reactor power.

The sorbent material is the subject of a co-pending application. It is a solid polymer sorbent composed of a composite ether of a maleic anhydride copolymer and α-benzoin-oxime. This sorbent is capable of absorbing more than 99% of the Mo-99 from the uranyl sulfate reactor solution.

The solution containing uranium sulfate and all fission products not adhering to the sorbent material is returned to the reactor vessel. Thus, waste is contained and uranium is conserved. The operation can then be repeated after any chemical adjustments to the solution to compensate for removed material or consumed uranium.

Figure 3:
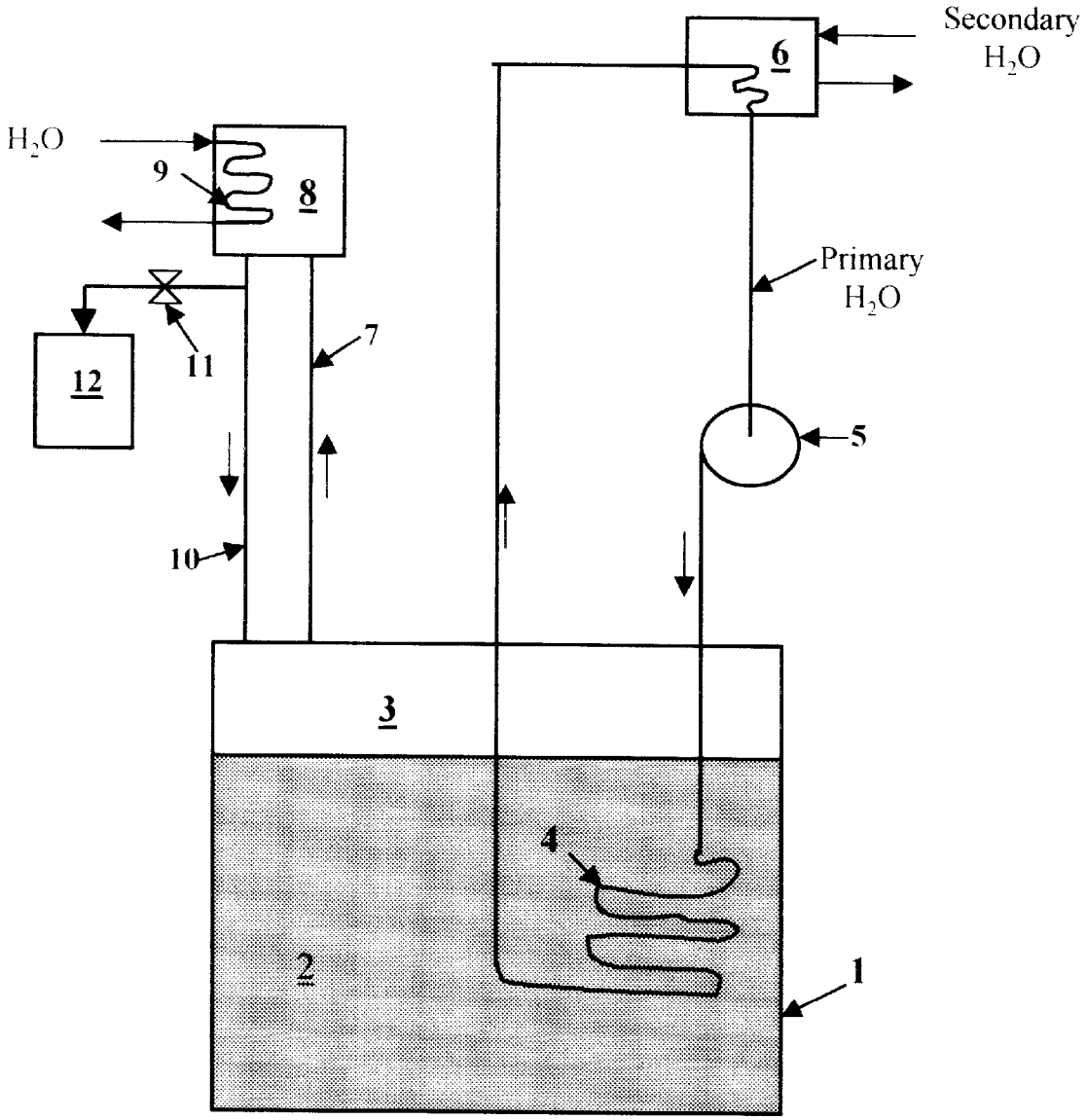
FIG. 3 diagrams the operation of the reactor.

FIG. 3 details the operation of the uranyl sulfate solution reactor in the preferred embodiment. The right-cylinder reactor container 1 holds about 20 liters of the uranyl sulfate solution 2 and has a free volume 3 above the solution to receive radiolytic gas formed during operation of the reactor. During operation, the reactor is critical and is operated at 20 kW. With increased cooling, the reactor could be operated up to 100 kW. Heat is removed from the uranyl sulfate solution through a cooling coil 4 containing circulating distilled water. A first pump 5 moves the cooling water through the coils to a first heat exchanger 6. The secondary side of the heat exchanger 6 uses city water.

During operation of the reactor, $H_2$ and $O_2$ radiolytic gas is formed in the solution. This gas bubbles to the surface of the solution and rises 7 to the catalytic (platinum) recombiner 8 where the hydrogen and oxygen are burned to form pure steam. The heat of burning is removed in a second heat exchanger and the steam condensed to water. The secondary side of the second heat exchanger 9 can again use city water. The first liter of water so formed is directed to a water container 12 by opening valve-1 11. The remaining water is returned to the reactor container 1.

Figure 4:
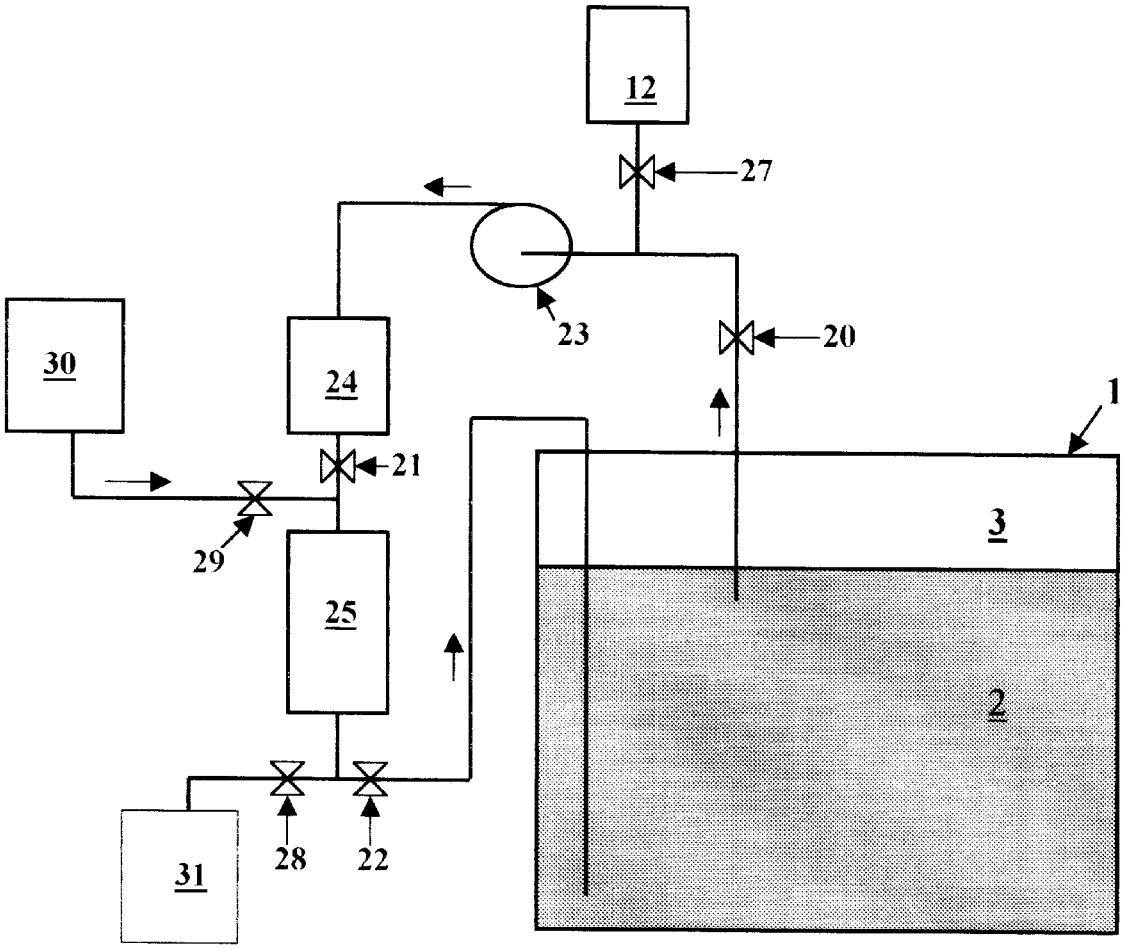
FIG. 4 diagrams the Mo-99 extraction process.

The extraction process to isolate Mo-99 is shown in FIG. 4. After the reactor is shutdown, the radioactivity is allowed to decay for a selected period of time up to a day. Then valve-3 20, valve-4 21, and valve-7 22 are opened. All other valves remain closed. A second pump 23 is activated, drawing up the reactor fluid 2 containing uranium and fission products including Mo-99. This fluid is pumped through a third heat exchanger 24 to reduce its temperature to less than 30° C. It then passes through the sorbent 25 and finally through valve-7 22 back to the bottom of the reactor container. Note that the pump 23 draws the reactor fluid 2 from the top and returns it to the bottom. This provides a "layering" effect caused by the difference in density between the warmer reactor solution 2 and the cooler, denser pumped fluid. The cooler pumped fluid has been stripped of Mo-99 and is thereby kept separated from the "unstripped" solution 2 in the reactor.

The flow rate of the pumped fluid is about 4 liters per hour (~1 ml/second) and the entire 20 liters of reactor solution 2 takes about five hours to pass through the sorbent 25. With adjustments to the sorbent 25 size and packing and with greater pressure from the pump 23, the flow rate could vary from 1 to 10 ml/second. After all of the fluid 2 has passed through the sorbent container 25, valve-3 20 is closed and valve-2 27 is opened. This permits the liter of pure water 12 to "wash" the sorbent of reactor fluid and also maintains the concentration of the reactor fluid 2. After the wash, valve-2 27, valve-3 20, valve-4 21, and valve-7 22 are closed and valve-6 28 and valve-5 29 are opened. From a storage container, the eluting solution 30 of 10 molar nitric acid passes through the sorbent and into a transfer container 31. About 80 ml of eluting fluid is used.

The reactor can be operated from one to five days at a time. Typically, the reactor is run for five days, allowed to cool for one day, and the Mo-99 extracted on the seventh day. This weekly cycle can vary depending on the demand for the product and the length of time used for the extraction process. The operation of the reactor at 20 kW power for five days results in a solution 31 containing 420 Curies of Mo-99 following a one day cooling period and a one day extraction period.

The efficiency of the Mo-99 extraction by the sorbent 25 is at least 90%. Other fission fragments in the extracted solution 31 are less than 2% and the solution contains less than 0.01% uranium. The preferred sorbent is a composite ether of a maleic anhydride copolymer and α-benzoin-oxime, the subject of a pending patent application. Well-known purification processes are subsequently used to purify the concentrated Mo-99 solution 31.

The method and apparatus of the present invention produces Mo-99 by a waste free, economical, and simple technology. Mo-99 is directly produced in the uranyl sulfate solution (pH~1) of a homogeneous solution nuclear reactor. No uranium is wasted because it is used again in the nuclear reactor as nuclear fuel after Mo-99 sorption from the solution. Radioactivity is not released beyond the reactor region due to a high selectivity of the sorbent used. Nuclear fuel reprocessing is not required for subsequent extraction cycles and the expense of manufacturing targets is not incurred.

The present invention is, of course, in no way restricted to the specific disclosure of the specifications and drawings, but also encompasses any modifications within the scope of the appended claims. The reactor could be run continuously, for example, as long as the cooling system keeps the reactor solution below boiling. The burn up of uranium is insignificant and additions would only be needed after hundreds of days of operation.

What is claimed is:

1. A method of collecting molybdenum-99 from fission products produced in a nuclear reactor, the method comprising:

providing a homogeneous solution nuclear reactor having a 20 to 100 kilowatt rating;

using a uranyl sulfate solution as a homogeneous fissionable material in the reactor;

running the reactor, thereby produce fission products including molybdenum-99 in the uranyl sulfate solution;

shutting down the reactor and allowing it to cool down;

pumping the uranyl sulfate solution from the top of the reactor through a heat exchanger means to cool the uranyl sulfate solution to below 30° C.;

passing the cooled uranyl sulfate solution to a column containing a sorbent for the selective absorption of Mo-99 and returning the non-absorbed portion of the uranyl sulfate back to the bottom of the reactor, the process continuing until substantially all of the uranyl sulfate solution has passed through the sorbent;

thereafter passing water through the sorbent column, said water being derived from recombining the $H_2$ and $O_2$ gases given off during the running of the reactor to thereby maintain the concentration of the uranyl sulfate solution; and thereafter passing nitric acid through the sorbent to extract the Mo-99 from the sorbent and collecting the resulting solution in a separate container.

2. The method of claim 1, wherein the sorbent is a composite ether of a maleic anhydride copolymer and α-benzoin-oxime.

3. The method of claim 2, wherein the acid passed through the sorbent is 10 molar nitric acid.

4. The method of claim 1, wherein the reactor is operated for a period between one and five days.

5. The method of claim 1, wherein the reactor contains about 20 liters of uranyl sulfate solution.

6. The method of claim 1, wherein the uranyl sulfate solution is passed through the sorbent column at a rate of about 1 to 10 milliliters per second.

7. A system for the collection of Mo-99 from fission products produced in a nuclear reactor, comprising:

a reactor vessel containing a selected quantity of uranyl sulfate solution as a homogeneous fissionable material for producing fission products including Mo-99;

a sorbent column containing a sorbent capable of selectively absorbing Mo-99;

heat exchanger means to cool a portion of said uranyl sulfate solution;

means for directing a portion of said uranyl sulfate solution from the reactor vessel through said heat exchanger means and then through said sorbent column and thereafter back to the vessel;

means for adding acid to said sorbent after substantially all of the uranyl sulfate solution has passed through the sorbent, thereby removing the absorbed Mo-99 from said sorbent;

means to collect the Mo-99 removed from the sorbent.

8. The system of claim 7, wherein approximately 20 liters of uranyl sulfate solution is contained in the reactor.

9. The system of claim 7, wherein the reactor is operated from between 20 kW and 100 kW power rating.

10. The system of claim 7, wherein the sorbent is a composite ether of a maleic anhydride copolymer and α-benzoin-oxime.

11. The system of claim 10, wherein the acid passed through the sorbent is 10 molar nitric acid.

12. The system of claim 7, wherein the removed portion of the uranyl sulfate solution is cooled to below 40 degrees C.

13. The system of claim 7, wherein the uranyl sulfate solution is passed through the sorbent column at a rate of about 1 to 10 milliliters per second.

* * * * *